United States Patent [19]

Crist et al.

[11] 4,005,534

[45] Feb. 1, 1977

[54] SHOE PROTECTION DEVICE

[75] Inventors: Harold Crist; Robert A. Crist, both of Arbovale, W. Va.

[73] Assignee: The Raymond Lee Organization, Inc., a part interest

[22] Filed: Jan. 2, 1976

[21] Appl. No.: 646,283

[52] U.S. Cl. ..... 36/72 R

[51] Int. Cl.[2] ..... A43B 13/22

[58] Field of Search ..... 36/72 R, 72 C

[56] References Cited

UNITED STATES PATENTS

| | | | |
|---|---|---|---|
| 1,742,763 | 1/1930 | Gerard | 36/72 R |
| 3,421,234 | 1/1969 | Sargent | 36/72 R |
| 3,716,932 | 2/1973 | Pakulak | 36/72 R |

*Primary Examiner*—Patrick D. Lawson

[57] ABSTRACT

A hollow metal member has the exterior shape of a shoe tip and an interior chamber of like shape communicating with a rear opening in the member. Four strap receiving loops are secured to the outer surface of the two opposite sides of the member, two loops on one side thereof, two loops on the other side. The loops extend outward and are positioned adjacent the rear opening, lying in a common vertical plane disposed at right angles to the direction of elongation of the member. Elongated strap means detachably securable at each end to a corresponding set of two loops can be used to hold the member in place on a shoe.

3 Claims, 6 Drawing Figures

FIG. 1
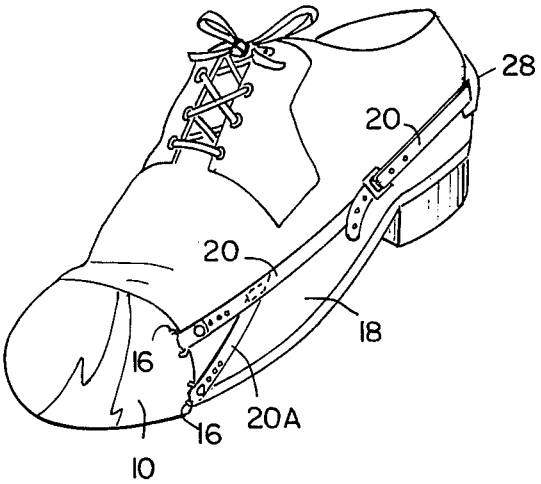
FIG. 2
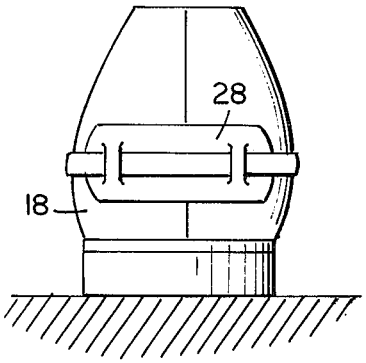
FIG. 3
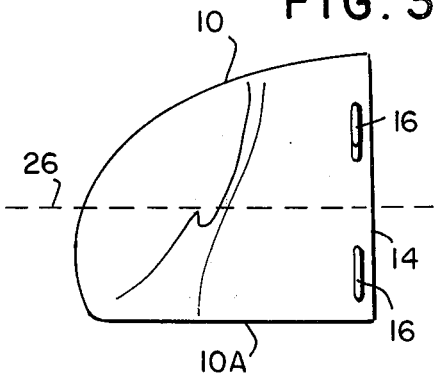
FIG. 4
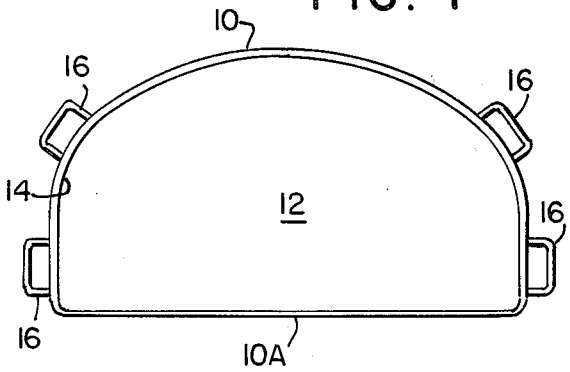
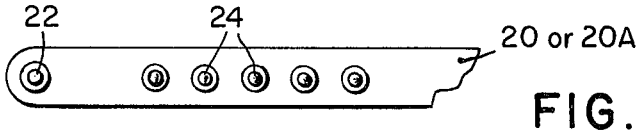
FIG. 5
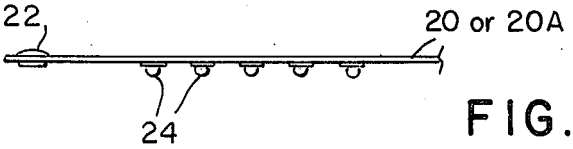
FIG. 6

SHOE PROTECTION DEVICE

SUMMARY OF THE INVENTION

Certain types of work shoes have metal shoe tips secured thereto as protection against damage to the toes when the wearer is engaged in activities in which such damage can occur. The wearer must also have conventional shoes for use when the wearer is not so engaged.

This invention is directed toward a protection device which can be detachably secured to a conventional shoe to provide toe protection and which can be removed to allow the shoe to be used in conventional manner.

In accordance with the invention a hollow member has the external shape of a shoe tip and also has an internal chamber of like shape communicating with a rear opening therein. An even plurality (typically equal to four) strap receiving loops are secured to the outer surface of the member and extend outward. The straps are disposed about the periphery of the opening, with half of the straps disposed on one side of the member and the remaining half being disposed on the opposite side of the member. The loops lie in a common vertical plane disposed at right angles to the direction of elongation (ie, the longitudinal axis) of the member.

Elongated strap means detachably secured at each end to a corresponding set of two loops will extend around the heel of the shoe to hold the member detachably in position on a shoe to provide the protection previously described.

BRIEF DESCRIPTION OF THE DRAWINGS

FIG. 1 is a perspective view showing the invention in use.

FIG. 2 is an end view of the structure in FIG. 1.

FIG. 3 is a side view of the tip protection member shown in FIG. 1.

FIG. 4 is a rear view of the tip protection member shown in FIG. 1.

FIG. 5 is a front view of a portion of the straps shown in FIG. 1.

FIG. 6 is a top view of the portion shown in FIG. 5.

DETAILED DESCRIPTION OF PREFERRED EMBODIMENTS

Referring now to FIGS. 1–6, a rigid member 10 formed for example of steel or aluminum has the external shape of a shoe tip and has an internal chamber 12 of like shape communicating with a rear opening 14.

The member can be made of metal or any other suitable material.

Four strap receiving loops 16 are secured to the outer surface of the member, two on one side, two on the other side, and extend outward. These loops are disposed about the periphery of opening 14 and lie in a common vertical plane disposed at right angles to the longitudinal axis 26 of the member.

The bottom portion 10A of the member has minimum uniform thickness required for structural integrity because when the member is disposed on the tip of shoe 18, the difference in level between the bottom surface of bottom 10A and that of the bottom surface of the sole of the shoe should be as small as possible for ease of walking. The remaining top, front and sides of the member have a second and larger uniform thickness to provide proper protection.

A main adjustment strap 20 is secured at each end to the upper one of the loops 16 on each side and extends through a curved horizontal support 28 which engages the rear of the shoe 18 when the tip of the shoe is inserted into the member 10. Adjacent each end of the strap is an extension 20A secured at one end to the strap and secured at the other end to the corresponding one of the lower loops 16.

Each end of the strap and each end of the extension which engage a loop can be adjusted in size by using the snap fasteners 22 and 24 thereon.

While the invention has been described with specific reference to the drawings, the protection sought is to be limited only by the terms of the claims which follow.

We claim:

1. A protection device for a shoe, said device comprising:

a hollow metal member having the external shape of a shoe tip and having an internal chamber of like shape communicating with a rear opening in the member, the member having a bottom of a first uniform thickness;

an even plurality of strap receiving loops secured to the outer surface of the two opposite sides of the member and extending outwardly therefrom, half of said plurality of loops being secured to one side, the remaining half of said loops being secured to the opposite side, said loops being located along the periphery of said opening and lying in a common vertical plane located at right angles to the longitudinal axis of said member.

2. The device of claim 1, wherein the member has a top and sides of a second uniform thickness larger than the first thickness.

3. The device of claim 2 wherein said plurality is equal to four.

* * * * *